US012669274B2

(12) United States Patent
Mukaiyama et al.

(10) Patent No.: US 12,669,274 B2
(45) Date of Patent: Jun. 30, 2026

(54) FREEZING CIRCUIT

(71) Applicant: ADTEX Inc., Gunma (JP)

(72) Inventors: Hiroshi Mukaiyama, Gunma (JP); Hiroo Sato, Gunma (JP)

(73) Assignee: ADTEX Inc., Gunma (JP)

( * ) Notice: Subject to any disclaimer, the term of this patent is extended or adjusted under 35 U.S.C. 154(b) by 111 days.

(21) Appl. No.: 18/281,821

(22) PCT Filed: Jul. 30, 2021

(86) PCT No.: PCT/JP2021/028510
§ 371 (c)(1),
(2) Date: Sep. 13, 2023

(87) PCT Pub. No.: WO2022/201574
PCT Pub. Date: Sep. 29, 2022

(65) Prior Publication Data

US 2024/0151439 A1 May 9, 2024

(30) Foreign Application Priority Data

Mar. 22, 2021 (JP) ..... 2021-047929

(51) Int. Cl.
*F25B 39/02* (2006.01)
*F25B 21/00* (2006.01)

(52) U.S. Cl.
CPC ..... *F25B 39/02* (2013.01); *F25B 21/00* (2013.01); *F25B 2339/02* (2013.01)

(58) Field of Classification Search
CPC .... F25B 21/00; F25B 39/02; F25B 2321/002; F25B 2339/02; F25B 2339/0242
See application file for complete search history.

(56) References Cited

U.S. PATENT DOCUMENTS 2,148,413 A * 2/1939 Labberton ..... F25B 39/02 62/212
5,490,398 A 2/1996 Cline
(Continued)

FOREIGN PATENT DOCUMENTS

CN 110975152 A 4/2020
JP 9-55322 A 2/1997
(Continued)

OTHER PUBLICATIONS

International Search Report (ISR) dated Aug. 31, 2021 filed in PCT/JP2021/028510.
(Continued)

*Primary Examiner* — Marc E Norman
(74) *Attorney, Agent, or Firm* — RANKIN, HILL & CLARK LLP

(57) ABSTRACT

Provided is a refrigeration circuit capable of stably generating a magnetic field from a coil of a magnetic field generation device for a long period of time. The refrigeration circuit includes a compressor (11), a condenser (12), an expansion valve (13), an evaporator connected to each other through a refrigerant pipe (10). The evaporator is formed from a coil (14) formed with multiple through-holes (21) in which refrigerant flows, having a rectangular section, and wound in a solenoid shape, and the coil (14) generates a magnetic field. With this configuration, the coil (14) as the evaporator can be efficiently cooled with refrigerant, and therefore, a strong magnetic field can be stably generated for a long period of time.

7 Claims, 9 Drawing Sheets

(56) References Cited

U.S. PATENT DOCUMENTS

| | | | | |
|---|---|---|---|---|
| 2005/0005611 | A1 | 1/2005 | Owada | |
| 2011/0077451 | A1 | 3/2011 | Marchitto et al. | |
| 2014/0326010 | A1 | 11/2014 | Kawakami et al. | |
| 2015/0196221 | A1 | 7/2015 | Garside | |
| 2016/0238265 | A1 | 8/2016 | Sherbeck et al. | |
| 2016/0256704 | A1 | 9/2016 | Petty et al. | |
| 2018/0094849 | A1* | 4/2018 | Petrenko | F25D 21/08 |
| 2018/0142932 | A1* | 5/2018 | Knatt | F25B 39/00 |
| 2020/0231425 | A1* | 7/2020 | Porter | B67D 1/0861 |
| 2021/0236328 | A1 | 8/2021 | Popielarski et al. | |

FOREIGN PATENT DOCUMENTS

| | | | |
|---|---|---|---|
| JP | 2003139460 | A | 5/2003 |
| JP | 2018-510700 | A | 4/2018 |
| KR | 10-2020-0028581 | A | 3/2020 |
| WO | 2013/093991 | A1 | 6/2013 |

OTHER PUBLICATIONS

International Search Report (ISR) dated Aug. 31, 2021 filed in PCT/JP2021/028511.
Cited in US Office Action (USOA) dated Apr. 3, 2026 and issued for U.S. Appl. No. 18/281,823.

* cited by examiner (A)

(B)

FREEZING CIRCUIT

TECHNICAL FIELD

The present invention relates to a refrigeration circuit, and particularly relates to a refrigeration circuit capable of stably generating a magnetic field for a long period of time.

BACKGROUND ART

Typically, alternating magnetic field treatment in which a tumor cell is killed using heating by an alternating magnetic field has been known (e.g., Patent Literature 1). A coil using the principle of induction heating, such as an induction heater, generates heat by supply of great current to the coil. It has been known that the coil is cooled by supply of coolant water into the coil.

FIG. 11 is a diagram showing a cooling system 501 of the prior art. Referring to FIG. 11, the cooling system 501 has a configuration of a coil 502 of the prior art being cooled with coolant water. A pipe molded in a coil shape is used as the coil 502. Water can be supplied into the pipe of the coil 502. A high-frequency current generator 503 is connected to the coil 502.

In the cooling system 501, a path 504 for supplying coolant water to the coil 502 is formed. Provided on the path 504 are a tank 505 that stores coolant water, a pump 506 that sends the coolant water from the tank 505 such that the coolant water circulates in the path 504, and a radiator 507 that cools the coolant water circulating in the path 504. The coolant water flowing in the path 504 flows inside the pipe of the coil 502. Accordingly, the coil 502 is cooled.

CITATION LIST

Patent Literature

PATENT LITERATURE 1: JP-T-2018-510700

SUMMARY OF INVENTION

Problems to be Solved by Invention

It is inevitable that when power is supplied to the coil in order to generate a magnetic field, Joule heat is generated due to the electric resistance of the coil. For example, in a case where a great current of about 100 (A) is supplied as high-frequency alternating current, a resistance component is great.

For this reason, in a case where a resistance value is, for example, 1 (a), a heat of 1 (Ω)×100 (A)×100 (A)=10000 (W) is generated. In the case of cooling with water, 10 (kW) =4.18 (J/kg° C.)×10 (° C.)×Mass Flow Rate M (kg/s) needs to be satisfied in order to suppress the range of increase in the temperature of coolant water to 10 (° C.). That is, if the mass flow rate M satisfying the above-described equation is converted into a volume flow rate, a circulation water of 14 (L/min) needs to be sent.

However, it is necessary, on the other hand, to extremely decrease a coil pitch in a coil that generates a strong magnetic field. Thus, as described above, a pressure loss due to water circulation is enormous, and a large water pump for cooling is necessary.

The present invention has been made in view of the above-described problems. An object of the present invention is to provide the following refrigeration circuit as a magnetic field generation device. In the refrigeration circuit as the magnetic field generation device, a coil can be efficiently cooled by a useful cooling method, and a strong magnetic field can be stably generated for a long period of time.

Solution to Problems

A refrigeration circuit according to the present invention includes a compressor, a condenser, an expansion valve, an evaporator connected to each other through a refrigerant pipe, in which the evaporator is a coil formed in such a manner that a coil base formed with multiple through-holes in which refrigerant flows is wound in a solenoid shape, and the coil generates a magnetic field.

Effects of Invention

The refrigeration circuit of the present invention includes the compressor, the condenser, the expansion valve, the evaporator connected to each other through the refrigerant pipe. The evaporator is the coil formed in such a manner that the coil base formed with the multiple through-holes in which refrigerant flows is wound in the solenoid shape. With such a configuration, the coil as the evaporator of the refrigeration circuit can be efficiently cooled with refrigerant. In the refrigeration circuit of the present invention, the coil generates a magnetic field. Thus, a strong magnetic field can be stably generated from the cooled coil for a long period of time.

According to the refrigeration circuit of the present invention, the through-holes may be arranged in the roll diameter direction of the coil in the section of the coil base. With this configuration, the length of the coil in the roll axis direction thereof can be shortened, and a strong magnetic field can be generated with a high efficiency from a compact coil.

According to the refrigeration circuit of the present invention, the coil base may have a rectangular section, and may be wound such that the long sides of the section are along the roll diameter direction of the coil. With this configuration, the length of the coil in the roll axis direction thereof can be shortened, and a strong magnetic field can be generated with a high efficiency from a compact coil.

According to the refrigeration circuit of the present invention, the coil may be covered with an insulating material. With this configuration, the coil can be efficiently cooled with evaporated refrigerant.

The refrigeration circuit of the present invention may include a high-frequency current generator connected to the inlet and outlet sides of the coil to supply alternating current. With this configuration, a magnetic field can be generated with a high efficiency from the cooled coil.

According to the refrigeration circuit of the present invention, inlet-side and outlet-side couplings of the coil may be connected to the refrigerant pipe through insulators. With this configuration, current leakage from the coil to the refrigerant pipe can be prevented. Thus, high current can be safely supplied to the cooled coil, and a magnetic field can be safely generated with a high efficiency.

According to the refrigeration circuit of the present invention, hydrofluorocarbon, hydrofluoroolefin, carbon dioxide, or a refrigerant mixture thereof may be used as the refrigerant. With this configuration, the coil can be cooled, with a high efficiency, using refrigerant evaporation, and a strong magnetic field can be stably generated for a long period of time.

DESCRIPTION OF EMBODIMENTS

Hereinafter, refrigeration circuits according to embodiments of the present invention will be described in detail with reference to the drawings. Note that illustrated forms are not intended to limit the present invention and are merely examples of the present invention.

Figure 1:
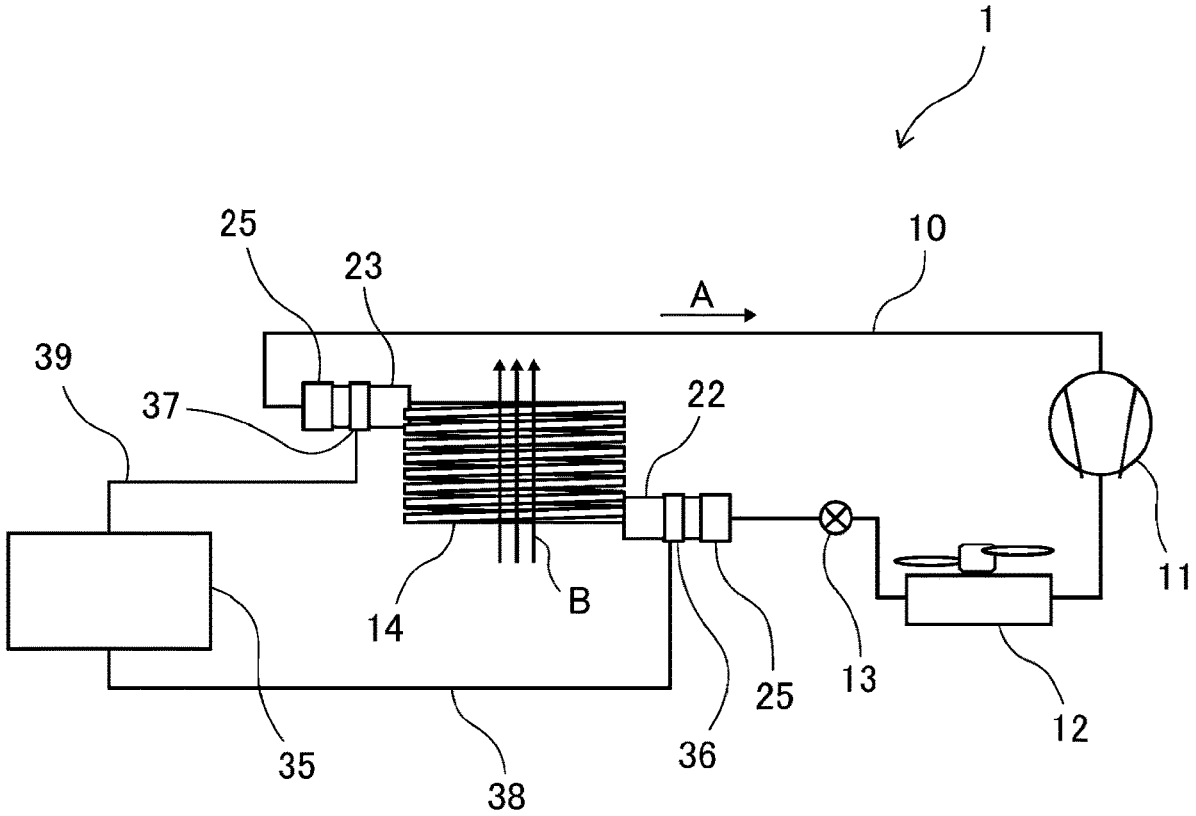
FIG. 1 is a diagram showing a refrigeration circuit according to an embodiment of the present invention.

FIG. 1 is a diagram showing a schematic configuration of a refrigeration circuit 1 according to an embodiment of the present invention. Referring to FIG. 1, the refrigeration circuit 1 has such a basic circuit configuration that a coil 14 that generates a magnetic field is provided and is cooled with refrigerant. The refrigeration circuit 1 forms a magnetic field generation device capable of stably generating a strong magnetic field from the coil 14 for a long period of time.

The coil 14 has, for example, a compact size equivalent to that of the head of a human body. The refrigeration circuit 1 is useful particularly in a case where a strong magnetic field needs to be generated by supply of great current to the coil 14. The refrigeration circuit 1 is suitable, for example, for treatment of a location where it is difficult or impossible to perform a typical surgery therefor, such as a brain tumor or a breast cancer.

Specifically, the refrigeration circuit 1 includes a compressor 11, a condenser 12, an expansion valve 13, and the coil 14 as an evaporator, these components being connected to each other through a refrigerant pipe 10. The refrigeration circuit 1 forms a vapor compression refrigeration cycle circuit that cools the coil 14 by evaporation of refrigerant.

The compressor 11 is a device that compresses refrigerant and sends the compressed refrigerant to the condenser 12. Compression devices of, e.g., a rotary type, a scroll type, a reciprocating type, a screw type, and other various types may be employed as the compressor 11.

Particularly, the rotary type compressor 11 is suitable for a compact refrigeration circuit 1 with a small cooling capacity. The compressor 11 may be of a two-stage compression type. The two-stage compression type compressor 11 is suitable for compression of high-pressure carbon dioxide refrigerant.

The condenser 12 is, for example, an air-cooling type heat exchanger to which an air blower fan sends air which is to exchange heat with refrigerant. For example, although not shown in the figure, the condenser 12 may be a fin-and-tube heat exchanger. That is, the condenser 12 has multiple tubes in which refrigerant flows, such as copper tubes, and multiple aluminum fins provided in parallel with each other, and the tubes are inserted into holes formed in the fins.

Note that the condenser 12 may be a water-cooling type heat exchanger. Heat exchangers of a plate type, a shell-and-tube type, a double tube type, and various other types may be employed as the condenser 12. Particularly, the plate type heat exchanger is preferable because the heat exchanger has a high heat exchange efficiency and the condenser 12 can be compactified.

The expansion valve 13 depressurizes refrigerant liquid having passed through the condenser 12. The expansion valve 13 has a function of adjusting the flow of refrigerant. An electronic expansion valve, a thermostatic expansion valve, a capillary tube, and various other valves may be employed as the expansion valve 13. The electronic expansion valve is employed as the expansion valve 13 so that control of cooling of the coil 14 can be made with a high efficiency and magnetic field generation performance can be improved.

The coil 14 is, for example, a member that generates an alternating magnetic field as indicated by arrows B, and has the function of the evaporator in the refrigeration cycle. Since the coil 14 is the evaporator, the coil 14 is cooled with refrigerant. The coil 14 does not have a high temperature even when high current is supplied thereto, and can stably generate a strong magnetic field for a long period of time. Details of the coil 14 will be described later.

The refrigeration circuit 1 has an electric circuit that operates the coil 14. The electric circuit is provided with a high-frequency current generator 35. The high-frequency current generator 35 is connected to the inlet side 22 of the coil 14 through a line 38, and is connected to the outlet side 23 of the coil 14 through a line 39. The high-frequency current generator 35 supplies alternating current to the coil 14. With this configuration, a magnetic field can be generated with a high efficiency from the cooled coil 14.

FIG. 1 shows a refrigerant path of the refrigeration cycle circuit formed by the refrigerant pipe 10, i.e., a refrigerant circulation path. Refrigerant flows in an A-direction in the refrigerant pipe 10, and circulates in the refrigerant path. Specifically, refrigerant compressed by the compressor 11 is sent to the condenser 12 through the refrigerant pipe 10, and is cooled by the condenser 12.

The refrigerant cooled by the condenser 12 flows into the expansion valve 13 through the refrigerant pipe 10, and is depressurized by the expansion valve 13. Then, the refrigerant is depressurized into low-temperature gas-liquid mixed fluid by the expansion valve 13, and is introduced into the coil 14 through the refrigerant pipe 10.

The refrigerant sent to the coil 14 is vaporized using heat generated by the current of the coil 14 as evaporative latent heat. That is, the refrigerant is evaporated inside the coil 14, thereby removing heat from the coil 14.

Subsequently, the refrigerant evaporated by the coil 14 returns to the compressor 11 through the refrigerant pipe 10, and is compressed again. The above-described process is repeated. That is, a refrigerant circulation flow is formed, in which refrigerant cools the coil 14 while flowing through the compressor 11, the condenser 12, the expansion valve 13, and the coil 14 as the evaporator in this order.

Refrigerant used in the refrigeration circuit 1 is, for example, hydrofluorocarbon, hydrofluoroolefin, carbon dioxide, or a refrigerant mixture thereof. With such refrigerant, the coil 14 can be cooled, with a high efficiency, using the evaporative latent heat of the refrigerant, and a strong magnetic field can be stably generated for a long period of time.

Note that the condenser 12 may be a gas cooler for a refrigerant with which a definite condensation is not observable. That is, fluorocarbon-based refrigerant, which is representative refrigerant, such as HFC-32 or HFC-404A has condensability at about −20 (° C.) to 42 (° C.) which is normal operation environment of the condenser 12. However, in the case of carbon dioxide refrigerant, operation is performed in a supercritical range, and for this reason, the condenser 12 is called a gas cooler. Even in a case where the condenser 12 is the gas cooler, the condenser 12 is a mechanism that cools refrigerant.

Figure 2:
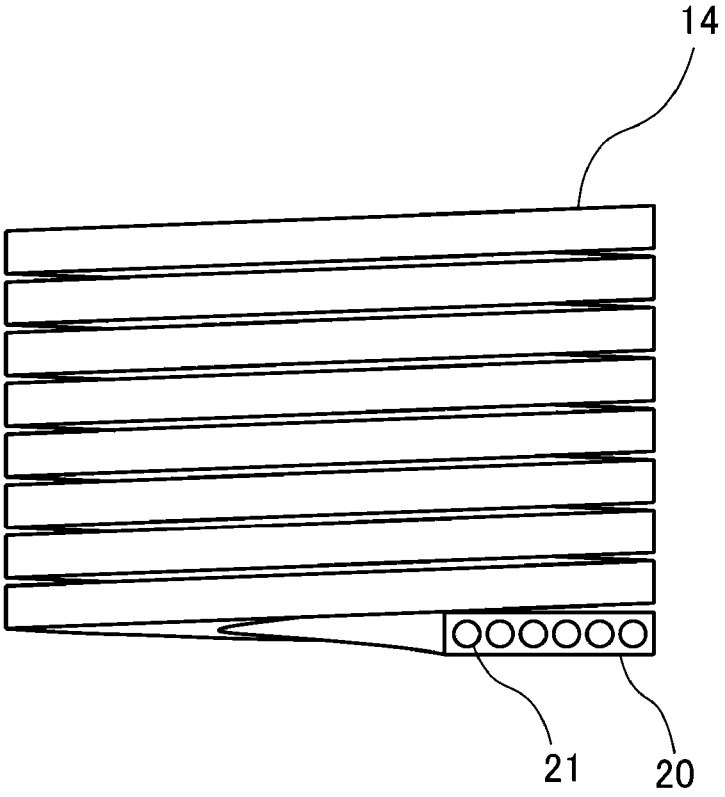
FIG. 2 is a view showing a coil of the refrigeration circuit according to the embodiment of the present invention.

FIG. 2 is a view showing a schematic configuration of the coil 14 of the refrigeration circuit 1. Referring to FIG. 2, the coil 14 is a member that generates a magnetic field by a current flow, and is wound in a solenoid shape. As described above, the coil 14 serves as the evaporator in the refrigeration cycle.

Specifically, the coil 14 is formed in such a manner that, e.g., a long flat plate made of a good conductor such as silver, aluminum, copper, or copper alloy is wound in a coil shape. More specifically, the coil 14 has such a form that the cross section of the flat plate which is the material of the coil 14 has a substantially rectangular shape, and is wound in a substantially spiral shape such that the long-side direction of the cross section is along the roll diameter direction of the coil 14 and the short-side direction is along the roll axis direction of the coil 14. In other words, the coil 14 is wound such that the short sides of the substantially rectangular cross section are along the substantially cylindrical shape.

The coil 14 has such a structure that multiple fine through-holes 21, i.e., microchannels, penetrate the coil 14, and refrigerant can be supplied to the through-holes 21. Specifically, the flat plate which is the material of the coil 14 is formed with the multiple fine through-holes 21 which penetrate the flat plate in the longitudinal direction thereof. That is, the coil 14 is formed with the multiple through-holes 21 which are flow paths in which refrigerant flows. Note that the coil 14 may be an induction coil.

Referring to FIG. 1, the voltage of a drive power source for the coil 14 is, for example, preferably 12 (V) to 440 (V) and more preferably 12 (V) to 100 (V). With this configuration, a magnetic field suitable for a treatment area can be generated. For example, in an example where the coil 14 is supplied, in terms of an effective value, with a voltage of 50 (V) and a current of 100 (A), the DC resistance component of the coil 14 is 0.5 (Ω) and a heat of 5 (kW) is generated.

Figure 3:
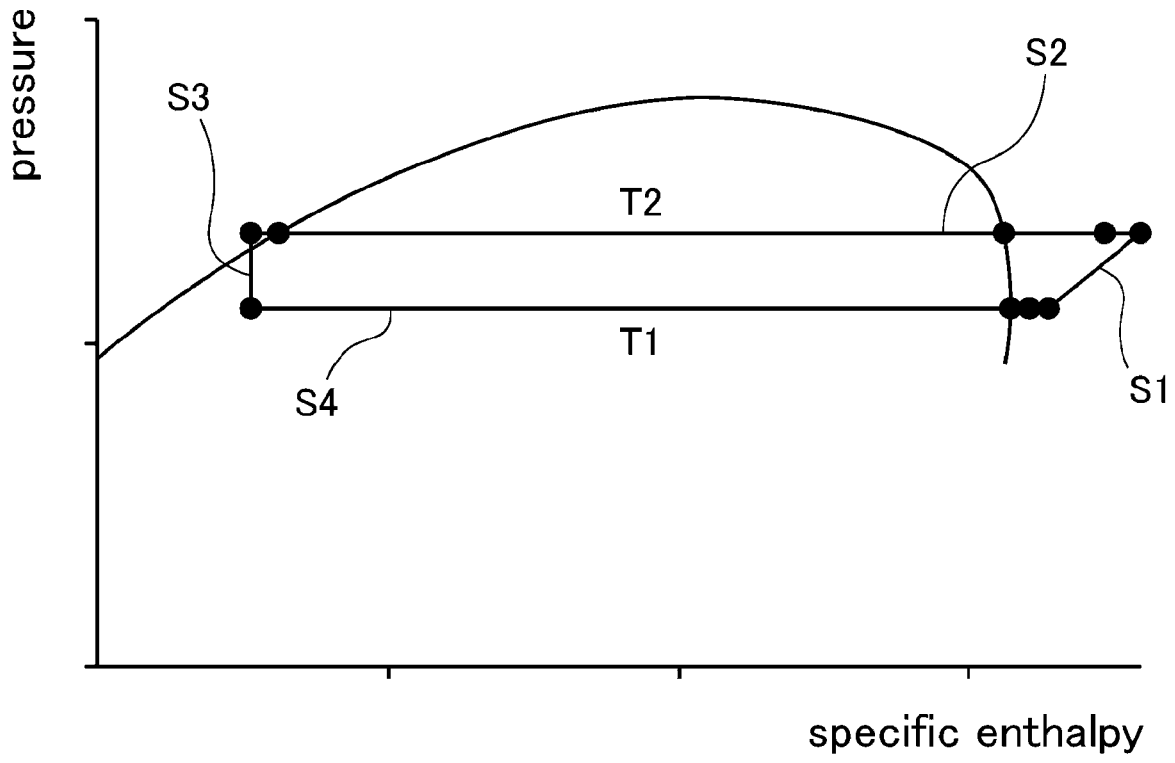
FIG. 3 is a p-h chart showing a state of the coil being cooled by the refrigeration circuit according to the embodiment of the present invention.

FIG. 3 is a pressure-enthalpy chart (p-h chart) showing a state of the coil 14 being cooled by the refrigeration circuit 1. Referring to FIGS. 1 and 3, refrigerant is compressed into high-pressure refrigerant by the compressor 11 in a compression process S1, and is cooled by the condenser 12 in a heat dissipation process S2. Subsequently, the refrigerant is depressurized by the expansion valve 13 in an expansion process S3, and is evaporated to cool the coil 14 in an evaporation process S4.

For example, a refrigeration cycle is formed, in which hydrofluorocarbon-based HFC-32 refrigerant generally used for an air-conditioner is evaporated at an internal temperature of 15 (° C.) in the coil 14 and is condensed at an internal temperature of 35 (° C.) in the condenser 12. That is, a refrigeration cycle is formed, in which a refrigerant evaporation temperature T1 in the evaporation process S4 is 15 (° C.) and a refrigerant condensation temperature T2 in the heat dissipation process S2 is 35 (° C.).

In this case, cooling can be performed if a refrigerant circulation amount is 0.01861 (kg/s), as shown in Table 1. In order to obtain such a refrigerant circulation amount, the excluded volume of the compressor 11 that rotates with a commercial power of 50 (Hz) is only required to be 10.6 (cc), and can be provided by a small compressor.

TABLE 1

| | | |
|---|---|---|
| Mass Flow Rate | kg/s | 0.01861 |
| Suction Density | kg/m3 | 35 |
| Volume Flow Rate | m3/s | 0.000532 |
| Compressor Rotation Speed | rot/s | 50 |
| Excluded Volume | cc | 10.63 |

Referring to FIG. 1, refrigerant is supplied to the coil 14, and at the same time, current is supplied to the coil 14. In order to supply current to the coil 14, electrodes 36, 37 are provided in the vicinity of two end portions of the coil 14, i.e., on the inlet side 22 and the outlet side 23, in the refrigeration circuit 1.

Of the high-frequency current generator 35, one output terminal is connected to the electrode 36 on the inlet side 22 of the coil 14 through the line 38, and the other output terminal is connected to the electrode 37 on the outlet side 23 of the coil 14 through the line 39.

Note that the refrigerant pipe 10 forming the refrigerant path in which refrigerant flows is, for example, a copper pipe or a steel pipe. The refrigerant pipe 10 is made of a copper-based or iron-based material with an extremely-high conductivity. Thus, the current of the coil 14 may flow into the refrigerant path formed by the refrigerant pipe 10. This leads to a problem on current leakage to drive devices for the compressor 11, the expansion valve 13 and the like, and the outside of the refrigeration circuit 1.

Figure 4:
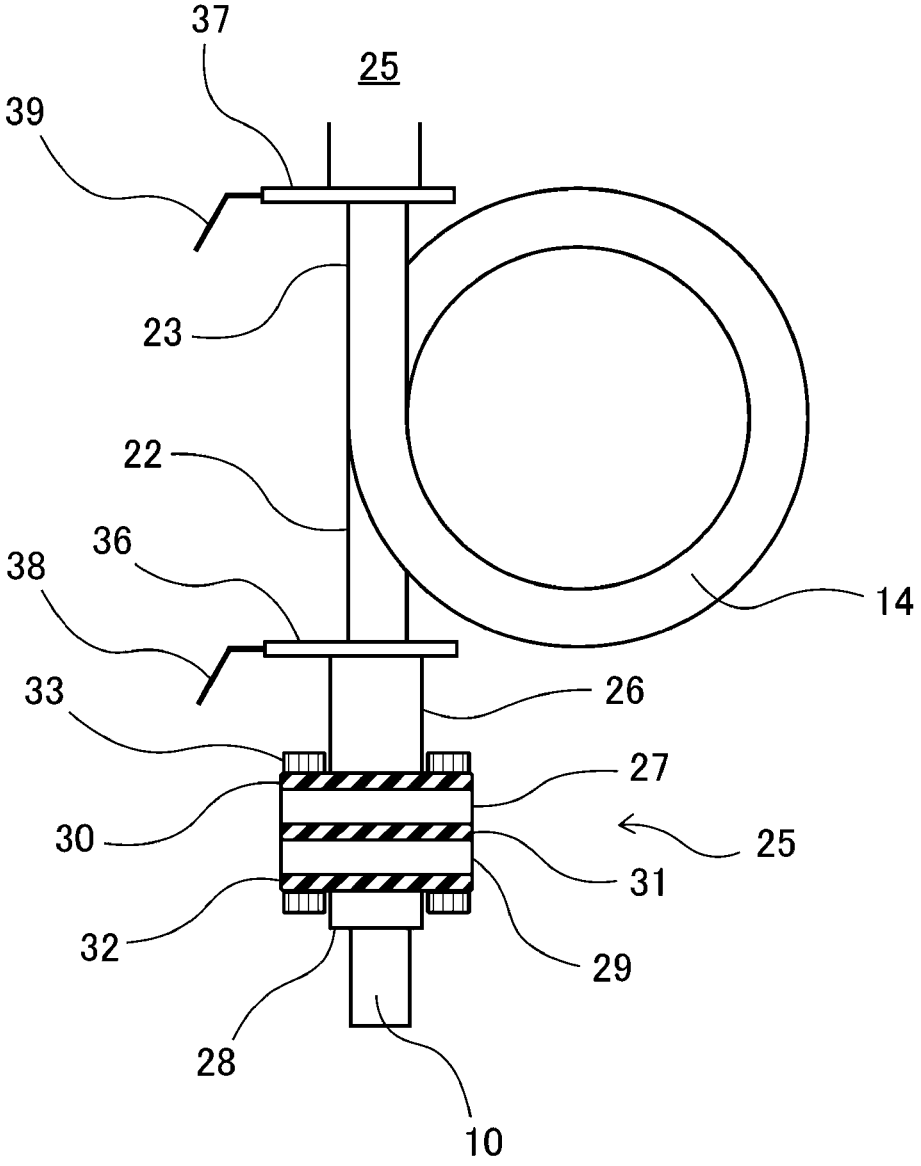
FIG. 4 is a view showing the configuration of the vicinity of end portions of the coil in the refrigeration circuit according to the embodiment of the present invention.

FIG. 4 is a view showing the configuration of the vicinity of the end portions of the coil 14 in the refrigeration circuit 1. In order to solve the above-described current leakage problem, an insulator 31 is provided at a connection portion 25 between the coil 14 and the refrigerant pipe 10 in the refrigeration circuit 1, as shown in FIG. 4.

Specifically, the insulator 31 is provided between a coil-side flange 27 which is a flange portion of a coil-side coupling 26 and a pipe-side flange 29 which is a flange portion of a pipe-side coupling 28. That is, the coil-side flange 27 and the pipe-side flange 29 are connected to each other through the insulator 31.

The insulator 31 is made, for example, of synthetic resin having excellent insulation properties, such as polytetrafluoroethylene (PTFE). The insulator 31 may include a base such as paper, cloth, or various other synthetic fibers. The insulator 31 may be insulating paint. The insulator 31 is provided between the coil-side flange 27 and the pipe-side flange 29 as described above so that current leakage due to contact between the coil-side flange 27 and the pipe-side flange 29 can be prevented.

The coil-side coupling 26 and the pipe-side coupling 28 are fixed with a support member 33 such as a bolt and a nut. Thus, the flow of current from the coil 14 to the refrigerant pipe 10 through the support member 33 needs to be blocked.

For this reason, a coil-side insulator 30 is provided between the coil-side flange 27 and the support member 33, and a pipe-side insulator 32 is provided between the pipe-side flange 29 and the support member 33.

The coil-side insulator 30 and the pipe-side insulator 32 are made, for example, of synthetic resin having excellent insulation properties. The coil-side insulator 30 and the pipe-side insulator 32 may include a base such as paper or cloth. The coil-side insulator 30 and the pipe-side insulator 32 are provided as described above so that current leakage through the support member 33 can be prevented.

As described above, the refrigeration circuit 1 is configured so that the flow of current from the coil 14 to, e.g., the outside through the refrigerant pipe 10 can be prevented. Thus, high current can be safely supplied to the cooled coil 14, and a magnetic field can be safely generated with a high efficiency.

Note that hydrofluorocarbon, hydrofluoroolefin, and carbon dioxide used as refrigerant have favorable insulation properties. Particularly, carbon dioxide has non-polar molecules, and therefore, is refrigerant extremely useful for the purpose of the present invention.

Figure 5:
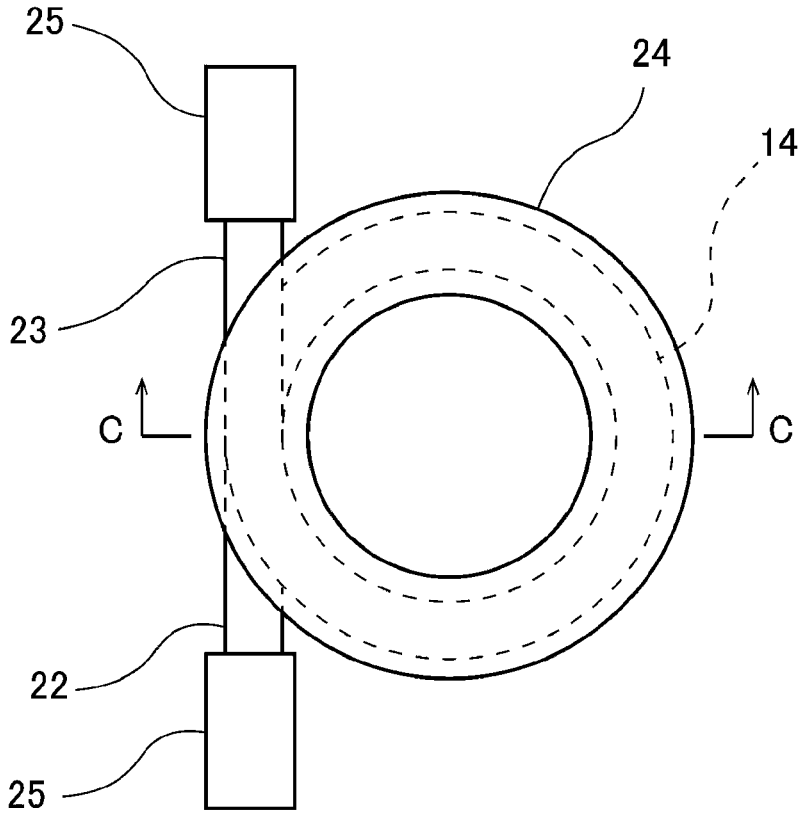
FIG. 5(A) is a plan view showing the coil of the refrigeration circuit according to the embodiment of the present invention.
FIG. 5(B) is a sectional view thereof.
Figure 5:
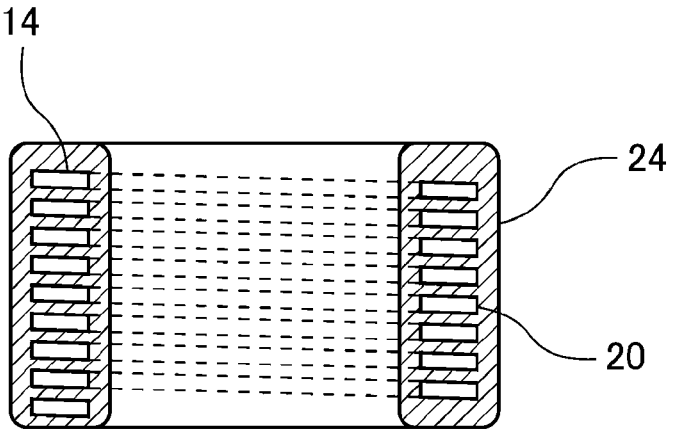

FIG. 5 shows views of a schematic configuration of the coil 14 of the refrigeration circuit 1. FIG. 5(A) is a plan view, and FIG. 5(B) is a sectional view along a C-C line of FIG. 5(A). As shown in FIG. 5, the substantially entirety of a coil base 20 portion of the coil 14 is covered with an insulating material 24.

The insulating material 24 is molded, for example, using a synthetic resin material such as acrylonitrile butadiene styrene (ABS) or polypropylene (PP). For example, a ceramic-based material may be used as the material of the insulating material 24. The insulating material 24 may be formed by coating of insulating paint. The substantially entirety of the coil 14 is covered with the insulating material 24 as described above so that current leakage from the coil 14 to a human body and a surrounding structure can be prevented.

Note that as described above, the coil 14 has the function of the evaporator in the refrigeration cycle. That is, refrigerant cools the coil 14 by evaporating in the course of flowing inside the coil 14. A general evaporator of the prior art has a structure with a function of generating cold energy. In other words, the general evaporator functions, for example, to generate cold air as in an air-conditioner or to make ices as in a refrigerator. For this reason, the evaporator of the prior art cannot fulfill its function if the entire surface thereof is covered as in the coil 14 according to the present embodiment.

However, in the case of the coil 14 as the evaporator according to the present embodiment, refrigerant is only required to remove heat generated by the coil 14 itself, and does not need to cool the outside. For this reason, there is no problem if the substantially entire surface of the coil 14 is covered with the insulating material 24. The coil 14 has a useful structure in properly designing insulation properties and adiabaticity for a human body and a surrounding structure. Thus, the coil 14 can be efficiently cooled with evaporated refrigerant, and magnetic force can be stably generated.

Figure 6:
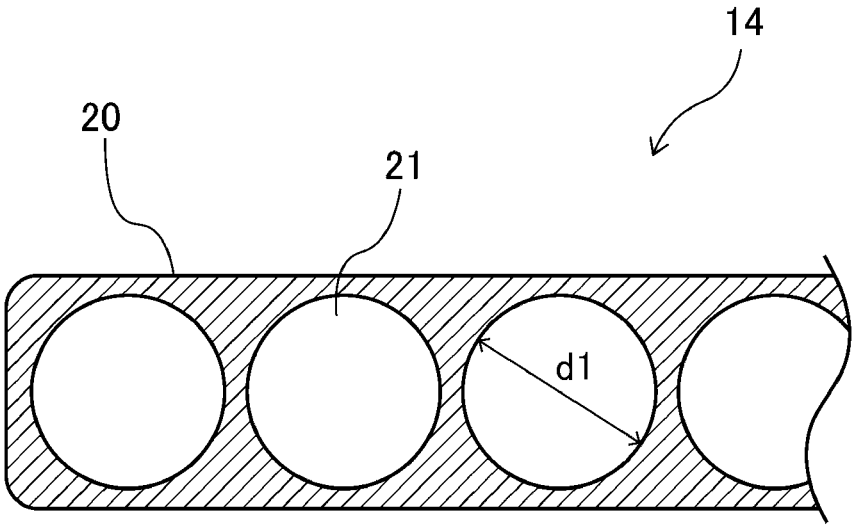
FIG. 6 is a sectional view of a coil base of the refrigeration circuit according to the embodiment of the present invention.

FIG. 6 is a sectional view showing the coil 14 of the refrigeration circuit 1. Specifically, FIG. 6 shows the cross section of the coil base 20 of the coil 14. As shown in FIG. 6, the section of the coil 14, i.e., the cross section of the coil base 20, is in a substantially rectangular shape. In other words, the coil 14 is formed of the plate-shaped coil base 20. Note that the short sides of the section of the coil 14 may be, for example, in a curved shape such as a substantially arc shape.

As shown in FIG. 2, the coil 14 is wound such that the short sides of the rectangular section are along the substantially cylindrical shape. In this manner, a solenoid that generates a magnetic field is formed. In order to generate a strong magnetic field in a substantially spiral structure such as the solenoid, a great number of turns per unit length is preferable. Thus, as shown in FIG. 6, the coil 14 has the substantially rectangular section, and the length of the short side of the section, i.e., the thickness t1 of the coil base 20, is small.

For example, in the example of FIG. 6, the thickness t1 of the coil base 20 is about 1 to 10 (mm) and preferably about 3 (mm). The refrigerant flow path, i.e., the through-hole 21, formed in the coil 14 having such a thin band-shaped rectangular section is a substantially circular fine hole having an inner diameter d1 of about 1 (mm).

Generally, in a case where water is supplied to such a fine hole, a flow resistance is extremely high. If a contamination or a foreign substance flows into the hole even a little, the hole is clogged, leading to local cooling failure. In the worst case, there is a risk of fusing. In the compactly-molded coil 14 that generates a strong magnetic field, the through-holes 21 are the fine holes, and it is impossible to perform typical cooling with water.

Refrigerant has an extremely-lower viscosity than that of water, and generally, can easily flow in a hole with an inner diameter d1 of about 1 (mm). The coil 14 functions as the evaporator in the refrigeration cycle and uses the evaporative latent heat of refrigerant, and therefore, can provide a high cooling performance while having a compact form with the fine through-holes 21. As a result, a magnetic field generation capacity can be obtained with a high efficiency.

Note that as described above, the coil 14 is made of the good conductor such as silver, aluminum, copper, or copper alloy. Copper or copper alloy is the most preferable as the material of the coil 14. Thus, high current can be supplied because of a small electric resistance, and cooling by refrigerant evaporation can be suitably performed because of a high thermal conductivity. Consequently, a strong magnetic field can be stably generated for a long period of time.

Next, coil bases 120, 220, 320, 420 different from the form of the coil base 20 will be described in detail as modifications of the embodiment with reference to FIGS. 7 to 10. Note that components other than the coil bases 120, 220, 320, 420 of the modifications in FIGS. 7 to 10 are the same as or similar to those of the above-described embodiment, and therefore, description thereof will be omitted.

Figure 7:
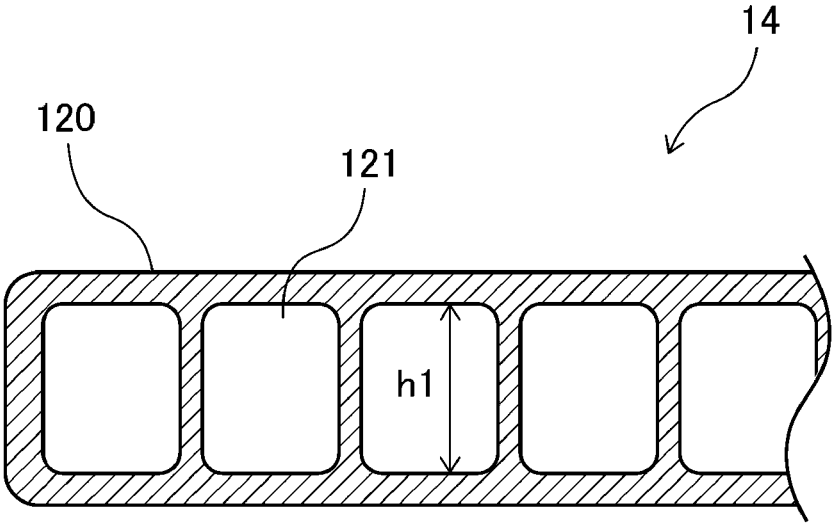
FIG. 7 is a sectional view of a coil base of a refrigeration circuit according to another embodiment of the present invention.

FIG. 7 is a sectional view showing the coil base 120 of the coil 14 according to another embodiment of the present invention, and shows the cross section of the coil base 120. As shown in FIG. 7, a through-hole 121 may be formed with a substantially quadrangular section.

For example, the through-hole 121 may be a substantially rectangular fine hole having a long-side length, i.e., a height h1, of about 1 (mm). With this form, advantageous effects similar to those of the coil 14 formed of the coil base 20 as shown in FIG. 6 are obtained. Moreover, a large heat transfer area of the evaporator is ensued, and better cooling performance is obtained. As a result, an excellent magnetic field generation capacity is obtained.

Note that the through-hole 121 is not limited to the above-described form, and for example, may be in other polygonal shapes.

Figure 8:
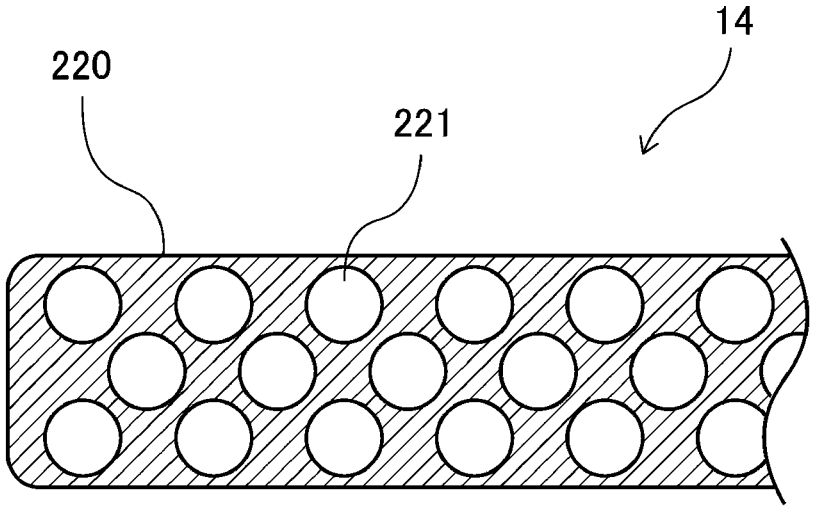
FIG. 8 is a sectional view of a coil base of a refrigeration circuit according to still another embodiment of the present invention.

FIG. 8 is a sectional view showing the coil base 220 of the coil 14 according to still another embodiment of the present invention. That is, FIG. 8 shows the cross section of the coil base 220. As shown in FIG. 8, through-holes 221 are formed in multiple lines substantially along the long sides of the section in the coil base 220.

Specifically, the coil base 220 has such a configuration that other refrigerant flow paths, i.e., the through-holes 221, are formed between the through-holes 221 as the refrigerant flow paths and the outer wall surface of the coil base 220. With such a configuration, advantageous effects similar to those of the coil base 20 shown in FIG. 6 can also be produced.

Further, the coil base 220 can have a larger surface area than those of the coil base 20 and the coil base 120 shown in FIG. 7. That is, since the through-holes 221 of the coil base 220 are provided in the multiple lines, the total circumferential area is larger than those of the through-holes 21 (see FIG. 6) of the coil base 20 and the through-holes 121 (see FIG. 7) of the coil base 120.

Since the surface area is larger as described above, the magnetic field generation performance of the coil 14 can be enhanced. Specifically, the coil base 220 is a member for supplying high-frequency current for generating a magnetic field. The current for generating the magnetic field unevenly flows on the surface of the coil base 220 due to a high-frequency current skin effect. A configuration of the fine holes, i.e., the through-holes 221, being formed such that the surface area increases results in a favorable flow of high-frequency current, and therefore, is useful in generating a strong magnetic field.

In other words, the surface area of the coil 14 formed of the coil base 220 in which high-frequency current flows increases by formation of multiple layers of the through-holes 221 as the fine holes. Thus, there is an advantage that an increase in the DC resistance component of the impedance of the coil 14 can be effectively suppressed.

Note that if the coil 14 is for external cooling, a configuration of the through-holes 221 being formed in the multiple lines is disadvantageous in terms of heat transfer. That is, heat inside the through-holes 221 needs to be transmitted to the outside of the coil base 220, and for this reason, a configuration of the other through-holes 221 being present between the through-holes 221 as the refrigerant flow paths and the outer wall surface of the coil base 220 as a cooling target surface cannot be employed. This is because the other through-holes 221 present between the through-holes 221 and the outer wall surface of the coil base 220 interfere with heat transfer.

On the other hand, the refrigeration circuit 1 according to the present embodiment is provided not for the purpose of external cooling, but for the purpose of cooling the coil 14 generating a magnetic field and heat. Thus, as described above, the configuration of the coil base 220 in which the through-holes 221 are formed in the multiple lines can be employed, and therefore, excellent magnetic field generation performance can be obtained. That is, the compact refrigeration circuit 1 capable of stably generating a strong magnetic field for a long period of time can be provided.

Note that the arrangement of the through-holes 221 is in a substantially zigzag pattern, but other arrangements may be employed.

Figure 9:
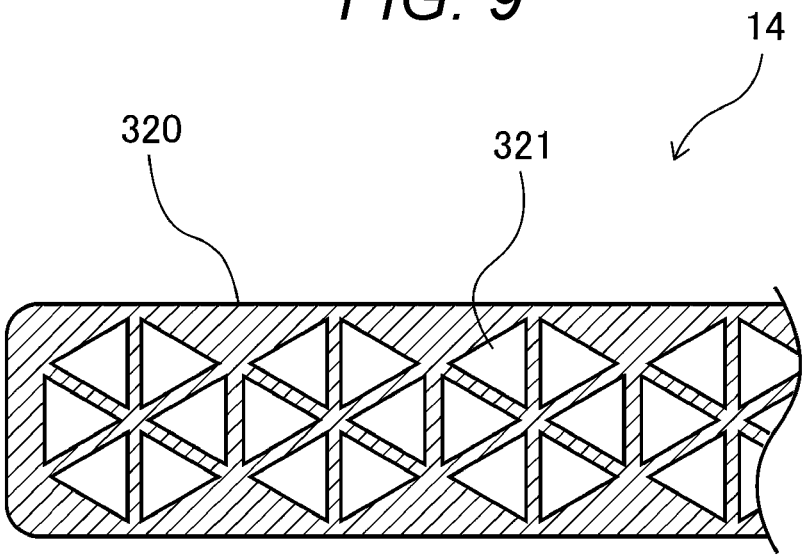
FIG. 9 is a sectional view of a coil base of a refrigeration circuit according to still another embodiment of the present invention.

FIG. 9 is a sectional view showing the coil base 320 according to still another embodiment of the present invention. FIG. 9 shows the cross section of the coil base 320 of the coil 14. As shown in FIG. 9, substantially triangular through-holes 321 are formed in multiple lines in the coil base 320.

Specifically, many through-holes 321 formed in a substantially triangular shape are provided such that the sides thereof are positioned close to and parallel with each other. The coil base 320 may be formed with such an arrangement that other through-holes 321 are present between the through-holes 321 and the outer wall surface of the coil base 320.

With such a configuration, excellent magnetic field generation performance can also be obtained as in the above-described coil base 220 shown in FIG. 8. Further, the area is larger in the case of the through-holes 321 of the coil base 320 than in the case of the through-holes 221 of the coil base 220. Thus, the high-performance refrigeration circuit 1 capable of more efficiently generating a magnetic field is provided.

Note that in the above-described example, the sectional shape of the through-hole 321 is the substantially triangular shape, but the sectional shape and arrangement of the through-holes 321 are not limited to above. A square shape, a rectangular shape, a trapezoidal shape, other quadrangular shapes, a pentagonal shape, a hexagonal shape, an oval shape, and various other shapes may be employed as the sectional shape of the through-hole 321. Moreover, various forms may be employed in terms of the number of lines of the through-holes 321 and the arrangement of the through-holes 321.

Figure 10:
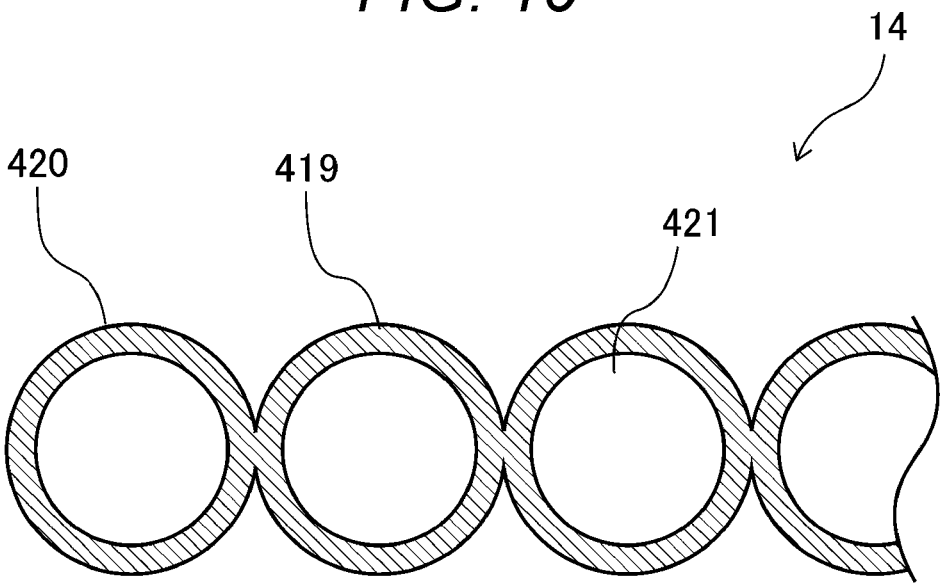
FIG. 10 is a sectional view of a coil base of a refrigeration circuit according to still another embodiment of the present invention.
Figure 11:
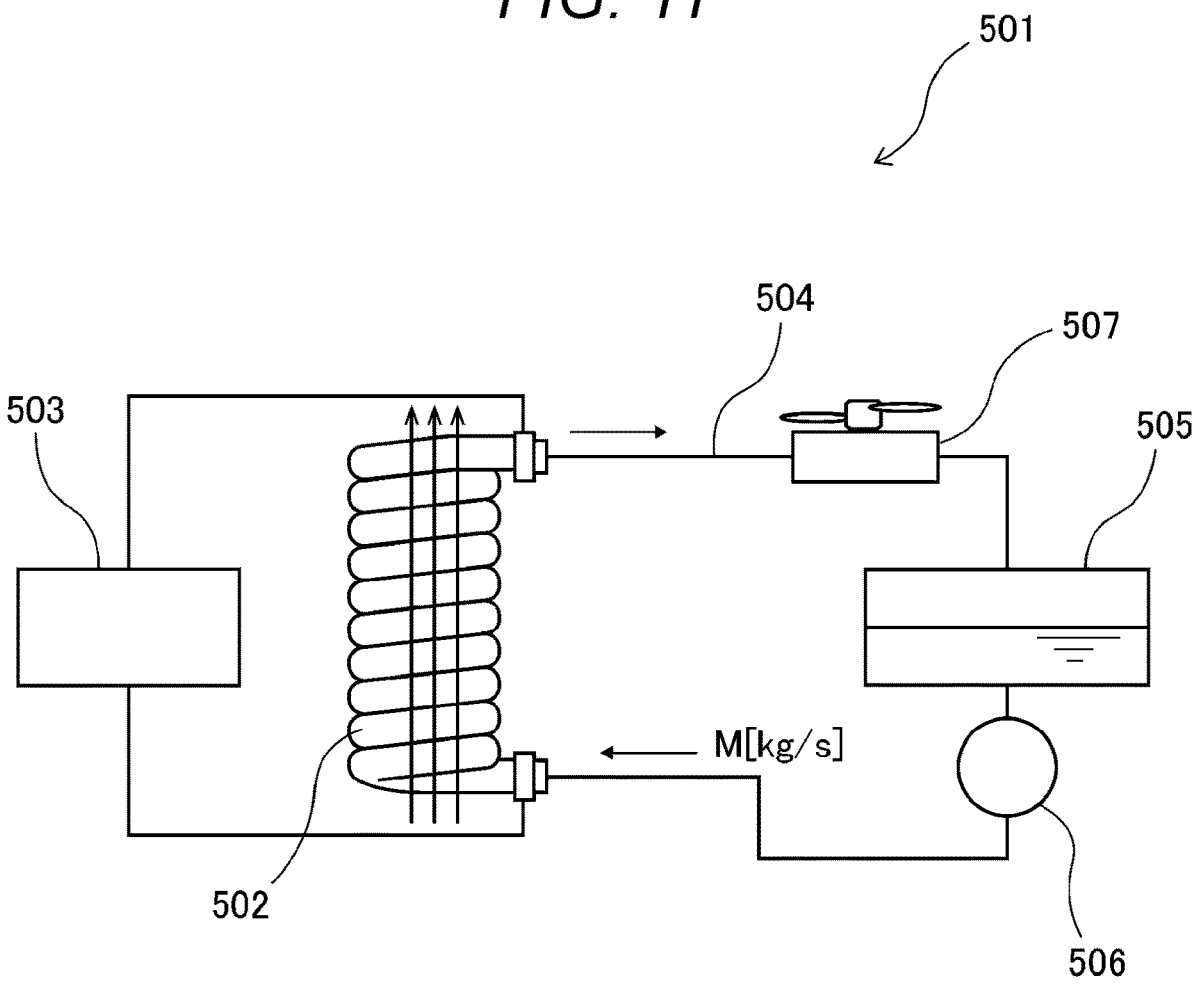
FIG. 11 is a diagram showing a circuit configuration of a cooling system of the prior art.

FIG. 10 is a sectional view showing the coil base 420 of the coil 14 according to still another embodiment of the present invention. FIG. 10 shows the cross section of the coil base 420. As shown in FIG. 10, the coil base 420 has such a form that multiple circular pipe portions 419 are joined to each other.

Specifically, the circular pipe portion 419 has a substantially circular pipe shape, and each circular pipe portion 419 is formed with a through-hole 421 having a substantially circular section. The coil base 420 has such a form that the multiple circular pipe portions 419 are joined in parallel. That is, in the section of the coil base 420, the through-holes 421 are arranged in the roll diameter direction of the coil 14.

With such a configuration, the length of the coil 14 in the roll axis direction can also be shortened and the high-performance compact coil 14 capable of generating a strong magnetic field can also be provided, as in the coil bases 20, 120, 220, 320 described above with reference to FIGS. 6 to 9. The section of the through-hole 421 is in a substantially circular shape, and therefore, resistance to a high pressure when carbon dioxide is employed as refrigerant can be obtained.

The circular pipe portions 419 may be joined to each other by, e.g., brazing after having been machined into the circular pipe shape. Thus, machining of the coil 14 is facilitated, and the productivity of the refrigeration circuit 1 is improved.

The through-holes 421, i.e., the circular pipe portions 419, may be arranged in line as shown in FIG. 10, or although not shown in the figure, may be arranged in multiple lines. The circular pipe portions 419 are provided in the multiple lines so that the total area of the through-holes 421 can be increased. Thus, the coil 14 can more efficiently generate a magnetic field.

Note that the section of the circular pipe portion 419 may be, other than the circular shape, in other shapes such as an elliptical shape, an oval shape, and a square tube shape.

As described above, the present embodiment has the following features.

(1) The structure in which current and coolant are supplied to the coil 14 having the sectional shape formed with the through-holes 21, 121, 221, 321, 421 which are the multiple fine holes in which the coolant can circulate in a narrow region.

(2) The cooling method in which the coolant of (1) is hydrofluorocarbon-based or hydrofluoroolefin-based refrigerant, single refrigerant of carbon dioxide, or a mixture thereof.

(3) The circuit configuration of the refrigeration circuit 1 in which the refrigerant of (2) circulates.

(4) The configuration of the connection portion 25 between the coil 14 and the refrigerant pipe 10, in which refrigerant and current can flow.

Note that although not shown in the figure, a configuration of being wound in a conical shape may be employed for the coil 14. With this configuration, a magnetic field generated inside the conical shape in response to current supplied to the coil 14 increases. Thus, the current flowing in the coil 14 can be relatively decreased, and the configuration of the refrigeration circuit 1 that cools the coil 14 can be further simplified.

As described above, according to the embodiments of the present invention, the refrigeration circuit 1 has structure and circuit configuration capable of directly cooling the coil 14 with refrigerant. Thus, the magnetic field generation device capable of efficiently performing cooling suitable for magnetic field generation and stably generating a predetermined magnetic field even when great current is supplied to the coil 14 is provided.

Note that the present invention is not limited to the above-described embodiments and various changes can be made without departing from the gist of the present invention.

LIST OF REFERENCE NUMBERS

1 Refrigeration circuit
10 Refrigerant Pipe
11 Compressor
12 Condenser
13 Expansion Valve
14 Coil
20, 120, 220, 320, 420 Coil Base
21, 121, 221, 321, 421 Through-Hole
22 Inlet Side
23 Outlet Side
24 Insulating Material
25 Connection Portion
26 Coil-Side Coupling
27 Coil-Side Flange
28 Pipe-Side Coupling
29 Pipe-Side Flange
30 Coil-Side Insulator
31 Insulator
32 Pipe-Side Insulator
33 Support Member
35 High-Frequency Current Generator
36 Electrode
37 Electrode
38 Line
39 Line
419 Circular Pipe Portion
d1 Inner Diameter
t1 Thickness
h1 Height
T1 Evaporation Temperature
T2 Condensation Temperature
S1 Compression Process
S2 Heat Dissipation Process
S3 Expansion Process
S4 Evaporation Process

The invention claimed is:

1. A refrigeration circuit comprising:

a compressor, a condenser, an expansion valve, an evaporator connected to each other through a refrigerant pipe, wherein the evaporator is a coil formed in such a manner that a coil base formed with multiple through-holes in which refrigerant flows is wound in a solenoid shape, and the coil generates a magnetic field.

2. The refrigeration circuit according to claim 1, wherein the through-holes are arranged in a roll diameter direction of the coil in a section of the coil base.

3. The refrigeration circuit according to claim 1, wherein the coil base has a rectangular section, and is wound such that a long side of the section is along a roll diameter direction of the coil.

4. The refrigeration circuit according to claim 1, wherein the coil is covered with an insulating material.

5. The refrigeration circuit according to claim 1, further comprising:

a current generator connected to inlet and outlet sides of the coil to supply alternating current.

6. The refrigeration circuit according to claim 1, wherein inlet-side and outlet-side couplings of the coil are connected to the refrigerant pipe through an insulator.

7. The refrigeration circuit according to claim 1, wherein hydrofluorocarbon, hydrofluoroolefin, carbon dioxide, or a refrigerant mixture thereof is used as the refrigerant.

* * * * *